US006273995B1

(12) United States Patent
Ikeda et al.

(10) Patent No.: US 6,273,995 B1
(45) Date of Patent: Aug. 14, 2001

(54) PAPER BULKING PROMOTER, HIGHLY BULKY PULP SHEET, AND PROCESS FOR PRODUCING THE PULP SHEET

(75) Inventors: Yasushi Ikeda; Hiromichi Takahashi; Toshiki Sowa; Koji Hamaguchi, all of Wakayama (JP)

(73) Assignee: Kao Corporation, Tokyo (JP)

( * ) Notice: Subject to any disclaimer, the term of this patent is extended or adjusted under 35 U.S.C. 154(b) by 0 days.

(21) Appl. No.: 09/194,441

(22) PCT Filed: Jul. 17, 1997

(86) PCT No.: PCT/JP97/02484

§ 371 Date: Nov. 25, 1998

§ 102(e) Date: Nov. 25, 1998

(87) PCT Pub. No.: WO98/03730

PCT Pub. Date: Jan. 29, 1998

(30) Foreign Application Priority Data

Jul. 18, 1996 (JP) ..... 8-189215

(51) Int. Cl.[7] ..... B31F 1/12

(52) U.S. Cl. ..... 162/111; 162/112; 162/116; 162/127; 162/138; 162/158; 162/199; 162/70; 162/71; 162/75; 162/76; 162/5; 252/174.21; 252/358; 252/351; 252/135; 516/69; 528/370

(58) Field of Search ..... 162/5, 111, 112, 162/116, 127, 138, 158, 199, 70, 71, 75–6; 252/174.21, 358, 351, 135; 516/69; 528/370

(56) References Cited

U.S. PATENT DOCUMENTS

| | | | |
|---|---|---|---|
| 3,956,401 | | 5/1976 | Scardera . |
| 4,351,699 | | 9/1982 | Osburn, III . |
| 4,448,638 | | 5/1984 | Klowak . |
| 4,632,730 | | 12/1986 | Ulubay . |
| 5,449,551 | | 9/1995 | Taniguchi . |
| 5,468,783 | | 11/1995 | Gebauer . |
| 5,503,714 | | 4/1996 | Reiners . |
| 5,817,212 | * | 10/1998 | Jobbins et al. ..... 162/5 |

FOREIGN PATENT DOCUMENTS

| | | |
|---|---|---|
| 878981 | 8/1971 | (CA) . |
| 0658650 | 6/1995 | (EP) . |
| 1402597 | 8/1975 | (GB) . |
| 4-862683 | 9/1973 | (JP) . |
| 48-62683 | 9/1973 | (JP) . |
| 57-136426 | 8/1982 | (JP) . |
| 58-149399 | 9/1983 | (JP) . |
| 1-306693 | 12/1989 | (JP) . |
| 3-124895 | 5/1991 | (JP) . |
| 3-269199 | 11/1991 | (JP) . |
| 4-185792 | 7/1992 | (JP) . |
| 4-370298 | 12/1992 | (JP) . |
| 5-230798 | 9/1993 | (JP) . |
| 621440 | 3/1994 | (JP) . |
| B2 6-21440 | 3/1994 | (JP) . |

OTHER PUBLICATIONS

Pulp and Paper Chemistry and Chemical Technology 3rd Edition, vol. 2 edited by J. M. Casey.

* cited by examiner

*Primary Examiner*—Stanley S. Silverman
*Assistant Examiner*—Mark Halpern
(74) *Attorney, Agent, or Firm*—Birch, Stewart, Kolasch and Birch, LLP

(57) ABSTRACT

A paper bulking promoter containing a compound represented by the following formula (1) with which a highly bulky sheet can be obtained without impairing paper strength:

$$RO(EO)_m(PO)_nH \quad (1)$$

wherein R represents a linear or branched alkyl or alkenyl group having 6 to 22 carbon atoms or an alkylaryl group in which the alkyl group has 4 to 20 carbon atoms; E represents an ethylene group; P represents a propylene group; m indicates the average number of moles added in the range of $0 \leqq m \leqq 20$; and n is a number in the range of $0 \leqq n \leqq 50$; provided that the EO and PO groups may have any of block and random arrangements and may begin with any of EO and PO.

19 Claims, No Drawings

PAPER BULKING PROMOTER, HIGHLY BULKY PULP SHEET, AND PROCESS FOR PRODUCING THE PULP SHEET

This application is the national phase under 35 U.S.C. §371 of prior PCT International Application No. PCT/JP97/02484 which has an International filing date of Jul. 17, 1997 which designated the United States of America, the entire contents of which are hereby incorporated by reference.

BACKGROUND OF THE INVENTION

1. Field of the Invention

This invention relates to a paper bulking promoter with which sheets of paper obtained from a pulp feedstock can be bulky without impairing paper strength.

2. Statement of Related Art

Recently, there is a desire for high-quality paper, e.g., paper excellent in printability and voluminousness. Since the printability and voluminousness of paper are closely related to the bulkiness thereof, various attempts have been made to improve bulkiness. Examples of such attempts include a method in which a crosslinked pulp is used (JP-A 4-185792, etc.) and a method in which a mixture of pulp with synthetic fibers is used as a feedstock for papermaking (JP-A 3-269199, etc.). Examples thereof further include a method in which spaces among pulp fibers are filled with a filler such as an inorganic (JP-A 3-124895, etc.) and a method in which spaces are formed (JP-A 5-230798, etc.). On the other hand, with respect to mechanical improvements, there is a report on an improvement in calendering, which comprises conducting calendering under milder conditions (JP-A 4-370298).

However, the use of a crosslinked pulp, synthetic fibers, etc. makes pulp recycling impossible, while the technique of merely filling pulp fiber spaces with a filler and the technique of forming spaces result in a considerable decrease in paper strength. Furthermore, the improvement in mechanical treatment produces only a limited effect and no satisfactory product has been obtained so far.

Also known is a method in which a bulking promoter is added during papermaking to impart bulkiness to the paper. Although fatty acid polyamide polyamines for use as such bulking promoters are on the market, use of these compounds results in a decrease in paper strength and no satisfactory performance has been obtained therewith.

DISCLOSURE OF THE INVENTION

3. Summary of the Invention

The inventors have made intensive investigations in view of the problems described above. As a result, they have found that by incorporating a specific alcohol and/or a polyoxyalkylene adduct thereof into a pulp feedstock, e.g., a pulp slurry, in the papermaking step, the sheet made from the feedstock can have low density (improved bulkiness) without detriment to paper strength. This invention has thus been achieved.

Namely, this invention provides a paper bulking promoter which comprises a compound represented by the following formula $$RO(XO)_aH$$

wherein R represents a linear or branched alkyl or alkenyl group having 6 to 22 carbon atoms or an alkylaryl group in which the alkyl group has 4 to 20 carbon atoms; X's are the same or different and each represents a linear or branched alkylene group having 2 or 3 carbon atoms; and a indicates the average number of moles added in the range of $0 \leqq a \leqq 20$.

This invention relates to a paper bulking promoter containing at least one compound (1) represented by formula (1):

$$RO(EO)_m(PO)_nH \quad (1)$$

wherein R represents a linear or branched alkyl or alkenyl group having 6 to 22 carbon atoms or an alkylaryl group in which the alkyl group has 4 to 20 carbon atoms; E represents an ethylene group; P represents a propylene group; and m and n respectively indicate the average number of moles added in the ranges of $0 \leqq m \leqq 20$ and $0 \leqq n \leqq 50$; provided that $(EO)_m(PO)_n$ may have any of block and random arrangements and may begin with any of EO and PO.

In formula (1), R is preferably a linear or branched alkyl or alkenyl group having 8 to 18 carbon atoms.

The compound (1) includes one obtained by causing a mixture of two or more ROH's to add at least either of EO and PO An alcohol represented by ROH is also included.

This invention further provides a paper bulking promoter composition which comprises the compound (1) and at least one nonionic surfactant based on a polyhydric alcohol.

The nonionic surfactant based on a polyhydric alcohol is preferably at least one member selected among sugar alcohol/EO (ethylene oxide, the same applies hereinafter) adducts, fatty acid esters of the adducts, fatty acid esters of sugar alcohols, sugar/EO adducts, fatty acid esters of the adducts, sugar/fatty acid esters, and fat/EO adducts. Especially preferred are fatty acid esters of sugar alcohol/EO adducts and fat/EO adducts.

The proportion of the compound (1) to the nonionic surfactant based on a polyhydric alcohol is desirably from 5/5 to 10/0 (by weight), preferably from 5/5 to 99/11 (by weight).

This invention also provides a process for producing a highly bulky pulp sheet which comprises adding the bulking promoter or composition in any of the papermaking process steps to thereby produce a highly bulky pulp sheet which has a bulk density lower by at least 5% than the product not containing the paper bulking promoter and a tearing strength as measured according to JIS P 8116 of at least 90% of that of the product. The highly bulky pulp sheet obtained by this process is also included. It is preferred that the bulking promoter or composition be mixed with water and a pulp feedstock to obtain a homogeneous slurry, which is subjected to sheet forming.

Further, an aqueous emulsion containing 10 to 100 wt. % of the bulking promoter or composition may be mixed with a pulp feedstock to obtain a homogeneous slurry, which is subjected to sheet forming.

In the bulking promoter composition, m and n are desirably in the ranges of $0 \leqq m \leqq 2$ and $0 \leqq n \leqq 50$, and the proportion of the compound (1) to the nonionic surfactant based on a polyhydric alcohol is desirably from 5/5 to 99/1 (by weight). Preferably, m and n each is zero and the proportion of the compound (1) to the nonionic surfactant based on a polyhydric alcohol is from 5/5 to 99/1 (by weight). The especially preferred range is from 7/3 to 95/5 (by weight).

This invention furthermore provides a highly bulky sheet which comprises the bulking promoter or composition and a pulp paper and which has a bulk density lower by at least 5% than the product not containing the paper bulking promoter and a tearing strength as measured according to JIS P 8116 of at least 90% of that of the product.

DETAILED EXPLANATION OF THE INVENTION

The term "paper bulking promoter" used herein means an agent with which a sheet of paper obtained from a pulp feedstock can have a larger thickness (can be bulkier) than that having the same basis weight obtained from the same amount of a pulp feedstock.

The compound represented by the formula (1) is one obtained by causing a higher alcohol, an alkylphenol, or the like in which the alkyl has 6 to 22 carbon atoms to add an alkylene oxide such as ethylene oxide (EO) or propylene oxide (PO). In this invention is used the compound in which the average number of moles of ethylene oxide added is in the range of $0 \leqq m \leqq 20$ . The range of the average number of moles added, m, is desirably $0 \leqq m \leqq 10$ , preferably $0 \leqq m \leqq 5$ . If m exceeds 20, the effect of imparting bulkiness to paper is lessened. Further, the compound used is one in which the average number of moles of propylene oxide (PO) added, n, is in the range of $0 \leqq n \leqq 50$ , preferably $0 \leqq n \leqq 20$ . When n exceeds 50, such a compound is economically disadvantageous although the decrease in performance is little.

R in the formula (1), which represents a linear or branched alkyl or alkenyl group having 6 to 22 carbon atoms or an alkylaryl group in which the alkyl has 4 to 20 carbon atoms, is preferably a linear or branched alkyl or alkenyl group having 8 to 18 carbon atoms. If R is an alkyl or alkenyl group in which the number of carbon atoms is outside the range of from 6 to 22 or if R is an alkylaryl group in which the number of carbon atoms of the alkyl group is outside the range of from 4 to 20, then the compound is less effective in imparting bulkiness to paper.

E and P in the formula (1) each represents a linear or branched alkylene group having 2 or 3 carbon atoms. Examples thereof include ethylene and propylene. When the group $(EO)_m(PO)_n$ in the general formula (1) is composed of a combination of polyoxyethylene and polyoxypropylene, the $C_2H_4O$ and $C_3H_6O$ groups may be in any of random and block arrangements. In this case, the polyoxypropylene ($C_3H_6O$) group(s) account for preferably at least 50 mol %, especially preferably at least 70 mol %, of all groups added on the average. The alkylene oxide group bonded to R may begin with any of EO and PO.

The paper bulking promoter of this invention preferably further contains a nonionic surfactant based on a polyhydric alcohol. By the use of a combination of the compound represented by the formula (1) and a nonionic surfactant based on a polyhydric alcohol, the effect of this invention can be improved. In particular, in the case where the compound represented by the formula (1) is less apt to dissolve in water when used alone and is difficult to evenly mix with a pulp feedstock, e.g., a pulp or pulp slurry, for example, in the case where the number of moles of EO added is 2 or smaller, in particular 0, then the effect of the combined use of the two ingredients is enhanced when this compound represented by the formula (1) is emulsified with the nonionic surfactant based on a polyhydric alcohol, although the compound can be dispersed mechanically.

The nonionic surfactant based on a polyhydric alcohol is desirably at least one member selected among sugar alcohol/EO adducts or fatty acid esters thereof, fatty acid esters of sugar alcohols, sugar/EO adducts or fatty acid esters thereof, sugar/fatty acid esters, and fat/EO adducts. Preferably, the nonionic surfactant based on a polyhydric alcohol is either of a fatty acid ester of a sugar alcohol/EO adduct and a fat/EO adduct. Especially preferred is a combination of these.

(1) Nonionic surfactants based on sugar alcohol

Examples of the nonionic surfactants based on a sugar alcohol include sugar alcohol/EO adducts, fatty acid esters of sugar alcohol/EO adducts, and fatty acid esters of sugar alcohols. The sugar alcohol as a component of a nonionic surfactant based on a polyhydric alcohol is an alcohol obtained from a monosaccharide such as a triose, tetrose, pentose, or hexose through reduction of the aldehyde or ketone group. Examples thereof include the glycerol derived from trioses, the erythritol and threitol derived from tetroses, the arabitol, ribitol, and xylitol derived from pentoses, and the sorbitol, mannitol, altrose, and galactitol derived from hexoses. The sugar alcohol/EO adducts are nonionic surfactants of the ether type. These adducts preferably are ether ester type nonionic surfactants derived from a sugar alcohol. In this case, part of the hydroxy groups of the sugar alcohol form an ester with a fatty acid. The fatty acid as a component of the fatty acid ester in a sugar alcohol/EO adduct may be any of saturated and unsaturated fatty acids each having 1 to 24, preferably 12 to 18, carbon atoms. Preferred is oleic acid. With respect to the degree of esterification of the sugar alcohol, the number of —OH groups which have undergone esterification may be any of from zero to all of the —OH groups, that is, the sugar alcohol may, for example, be in the form of a mono-, sesqui-, di-, or tri ester. However, the degree of esterification is preferably 1 to 3. In the sugar alcohol/EO adduct or its fatty acid ester, the average number of moles of EO added is 0 to 100, preferably 10 to 50. When the average number of moles of EO added is 0, this compound is a sugar alcohol/fatty acid ester, which type of nonionic surfactant may be used in this invention. Preferred examples of the nonionic surfactant based on a sugar alcohol for use in this invention are fatty acid esters of sugar alcohol/EO adducts. Most desirable among these are polyoxyethylene sorbitan/fatty acid esters.

(2) Nonionic surfactants based on sugar

Examples of the nonionic surfactants based on a sugar include sugar/EO adducts, fatty acid esters of sugar/EO adducts, and sugar/fatty acid esters. The sugar may be a polysaccharide such as sucrose, besides any of the monosaccharides mentioned above with regard to the sugar alcohol. In the sugar/EO adducts also, the average number of moles of EO added is 0 to 100, preferably 10 to 50. When the average number of moles of EO added is 0, this compound is a sugar/fatty acid ester. Examples of the sugar/fatty acid ester include sucrose/fatty acid esters. Examples of the fatty acid as a component of the ester may be the same as those mentioned above.

(3) Fat/EO adducts

Examples of fats usable as starting materials for the fat/EO adducts include vegetable oils such as castor oil, coconut oil, palm oil, olive oil, soybean oil, rapeseed oil, and linseed oil, animal fats such as porcine fat and beef tallow, fish oils, hardened and semihardened oils obtained therefrom, and recovery oils obtained during the purification of these fats. The most desirable among these fats is hardened castor oil. In the fat/EO adducts, the average number of moles of EO added is 5 to 100, preferably 10 to 50.

When the compound represented by formula (1) is used in combination with the nonionic surfactant based on a polyhydric alcohol as described above, the proportion of the compound represented by formula (1) to the nonionic surfactant based on a polyhydric alcohol is from 5/5 to 99/1, preferably from 7/3 to 95/5 (by weight). In the case where the nonionic surfactant based on a polyhydric alcohol is also used, the compound represented by formula (1) and the nonionic surfactant based on a polyhydric alcohol may be used in the form of an emulsion or mixture prepared by adding these ingredients to water under agitation. For industrial use, the emulsion or mixture has a concentration of about 10 to 100% from the standpoint of profitability.

The bulking promoter of this invention is applicable to a variety of ordinary pulp feedstocks ranging from virgin pulps such as mechanical pulps and chemical pulps to pulps prepared from various waste papers. The point where the bulking promoter of this invention is added is not particularly limited as long as it is within the papermaking process steps. In a factory, for example, the bulking promoter is desirably added at a point where it can be evenly blended with a pulp feedstock, such as, the refiner, machine chest, or headbox. After the bulking promoter of this invention is added to a pulp feedstock, the resultant mixture is subjected as it is to sheet forming. The bulking promoter remains in the paper. The paper bulking promoter of this invention is added in an amount of 0.01 to 10 wt. %, preferably 0.1 to 5 wt. %, based on the pulp.

The pulp sheet obtained by using the paper bulking promoter of this invention has a bulk density (the measurement method is shown in the Examples given later) lower by desirably at least 5%, preferably at least 7% than the product not containing the paper bulking promoter and has a tearing strength as measured according to JIS P 8116 of desirably at least 90%, preferably at least 95% of that of the product.

Effect of the Invention

By adding the bulking promoter of this invention in papermaking, a highly bulky sheet can be obtained without impairing paper strength.

EXAMPLES

This invention will be explained below in more detail by reference to Examples, but the invention should not be construed as being limited thereto. In the Examples, all parts and percents are based on weight unless otherwise indicated.

Examples 1 to 20 and Comparative Examples 1 to 6

[Pulp Feedstock]

The deinked pulp and virgin pulp shown below were used as pulp feedstocks.

<Deinked pulp>

A deinked pulp was obtained in the following manner. Feedstock waste papers collected in the city (newspaper/leaflet : 70/30%) were cut into a size of 4 cm by 4 cm, and a given amount of the cut paper was introduced into a bench disintegrator. Thereto were added warm water, 1% (based on the feedstock) of sodium hydroxide, 3% (based on the feedstock) of sodium silicate, 3% (based on the feedstock)of a 30% aqueous hydrogen peroxide solution, and 0.3% (based on the feedstock) of EO/PO block adduct of beef tallow/glycerol (1:1), as a deinking agent, in which the amounts of EO and PO were respectively 70 and 10 (average number of moles added). The feedstock was disintegrated at 40° C. for 10 minutes at a pulp concentration of 5%. The pulp slurry obtained was aged at 40° C. for 60 minutes and then diluted with warm water to a pulp concentration of 1%. The diluted slurry was subjected to flotation at 40° C. for 10 minutes. After the flotation, the slurry was washed with water and regulated to a concentration of 1% to prepare a deinked pulp (DIP) slurry. The DIP had a freeness of 220 ml.

<Virgin pulp>

A virgin pulp was prepared by cutting an LBKP (bleached hardwood pulp) into a size of 5 cm by 5 cm and disintegrating and beating a given amount of the cut LBKP with a beater at room temperature to give a 1% LBKP slurry. This LBKP had a freeness of 420 ml.

[Papermaking Method]

Each of the above 1% pulp slurries was weighed out in such an amount as to result in a sheet of paper having a basis weight of 60 g/m$^2$. The pH thereof was adjusted to 4.5 with aluminum sulfate. Subsequently, various bulking promoters were added in an amount of 3% based on the pulp. Each resultant mixture was formed into a sheet with a rectangular TAPPI paper machine using an 80-mesh wire. The sheet obtained was pressed with a press at 3.5 kg/cm$^2$ for 2 minutes and dried with a drum dryer at 105° C. for 1 minute. After each dried sheet was held under the conditions of 20° C. and a humidity of 65% for 1 day to regulate its moisture content, it was evaluated for bulk density as a measure of paper bulkiness and for tearing strength as a measure of paper strength performance. Ten found values were averaged.

<Evaluation item and method>

Bulkiness (bulk density)

The basis weight (g/m$^2$) and thickness (mm) of each sheet having a regulated moisture content were measured, and its bulk density (g/cm$^3$) was determined as a calculated value.

Equation for calculation:

$$\text{Bulkiness(bulk density)}=(\text{basis weight})/(\text{thickness})\times 0.001$$

The smaller the absolute value of bulk density, the higher the bulkiness. A difference of 0.02 in bulk density is sufficiently recognized as a significant difference.

Paper strength (tearing strength)

Each sheet having a regulated moisture content was examined according to JIS P 8116 (Testing Method for Tearing Strength of Paper and Paperboard).

Equation for calculation:

$$\text{Tearing strength}=A/S\times 16$$

Tearing strength: (gf)

A: Reading

S: Number of torn sheets

The larger the absolute value of tearing strength, the higher the paper strength. A difference of 20 gf in tearing strength is sufficiently recognized as a significant difference.

TABLE 1

| | Deinked pulp | | LBKP | |
|---|---|---|---|---|
| | Bulk density (g/cm$^3$) | Tearing strength (gf) | Bulk density (g/cm$^3$) | Tearing strength (gf) |
| Example 1 | 0.328 | 403 | 0.377 | 490 |
| Example 2 | 0.329 | 435 | 0.376 | 500 |
| Example 3 | 0.326 | 425 | 0.379 | 490 |
| Example 4 | 0.334 | 420 | 0.383 | 485 |
| Example 5 | 0.341 | 430 | 0.386 | 480 |
| Example 6 | 0.344 | 410 | 0.384 | 490 |
| Example 7 | 0.336 | 420 | 0.382 | 500 |
| Example 8 | 0.348 | 410 | 0.387 | 485 |
| Example 9 | 0.330 | 430 | 0.378 | 495 |
| Example 10 | 0.328 | 440 | 0.379 | 505 |
| Example 11 | 0.309 | 415 | 0.360 | 475 |
| Example 12 | 0.307 | 410 | 0.357 | 470 |
| Example 13 | 0.311 | 410 | 0.362 | 470 |
| Example 14 | 0.323 | 415 | 0.371 | 480 |
| Example 15 | 0.347 | 420 | 0.388 | 485 |
| Example 16 | 0.307 | 410 | 0.360 | 465 |
| Example 17 | 0.308 | 410 | 0.361 | 470 |
| Example 18 | 0.314 | 415 | 0.363 | 475 |
| Example 19 | 0.320 | 420 | 0.371 | 470 |
| Example 20 | 0.322 | 425 | 0.373 | 475 |

TABLE 1-continued

| | Deinked pulp | | LBKP | |
|---|---|---|---|---|
| | Bulk density ($g/cm^3$) | Tearing strength (gf) | Bulk density ($g/cm^3$) | Tearing strength (gf) |
| Comparative Example 1 | 0.370 | 450 | 0.408 | 500 |
| Comparative Example 2 | 0.372 | 430 | 0.414 | 490 |
| Comparative Example 3 | 0.368 | 435 | 0.409 | 480 |
| Comparative Example 4 | 0.367 | 425 | 0.410 | 505 |
| Comparative Example 5 | 0.375 | 430 | 0.414 | 490 |
| Comparative Example 6 | 0.330 | 280 | 0.379 | 345 |

<Bulking promoters used>

Example 1

Decyl alcohol/EO adduct; EOp (average number of moles of EO added; the same applies hereinafter)=1.5.

Example 2

EO/PO block adduct of lauryl alcohol; EOp =2.0, POp (average number of moles of PO added; the same applies hereinafter)=0.8.

Example 3

EO adduct of an octyl alcohol/decyl alcohol/lauryl alcohol/myristyl alcohol mixture (weight ratio: 8/38/30/24); EOp=1.2.

Example 4

EO/PO random adduct of a decyl alcohol/lauryl alcohol mixture (weight ratio: 60/40); EOp=1.6, POp=0.4.

Example 5

Dobanol/EO adduct; EOp=1.0.

Example 6

EO/PO random adduct of lauryl alcohol; EOp=10.0, POp=7.5.

Example 7

EO adduct of an octyl alcohol/decyl alcohol/oleyl alcohol mixture (weight ratio: 10/60/30); EOp=1.0.

Example 8

Nonylphenol/EO adduct; EOp=4.8.

Example 9

Mixture of decyl alcohol, polyoxyethylene (EOp=20.0) sorbitan trioleate, and polyoxyethylene hardened castor oil (EOp=30.0) (weight ratio: 80/14/6).

Example 10

Mixture of (A) EO adduct (EOp=1.2) of a decyl alcohol/lauryl alcohol/myristyl alcohol mixture (weight ratio:40/30/30), (B) polyoxyethylene (EOp =30.0) sorbitan monooleate, and (C) polyoxyethylene (EOp=25.0) hardened castor oil (weight ratio: 78/14/8).

Example 11

Lauryl alcohol.

Example 12

PO adduct of a lauryl alcohol/myristyl alcohol mixture (weight ratio: 50/50); POp=5.

Example 13

Mixture of lauryl alcohol, polyoxyethylene (EOp=14) sorbitan monooleate, and polyoxyethylene (EOp=25) hardened castor oil (weight ratio: 80/14/6).

Example 14

EO/PO random adduct of a lauryl alcohol/myristyl alcohol mixture (weight ratio: 70/30); EOp=2, POp=5.

Example 15

Stearyl alcohol.

Example 16

Stearyl alcohol/PO adduct; POp=10.

Example 17

Stearyl alcohol/PO adduct; POp=40.

Example 18

Oleyl alcohol.

Example 19

Mixture of lauryl alcohol, myristyl alcohol, and polyoxyethylene (EOp=12) sorbitan monooleate (weight ratio: 68/16/16).

Example 20

Mixture of lauryl alcohol and polyoxyethylene (EOp=25) hardened castor oil (weight ratio: 80/20).

Comparative Example 1

1-Butanol.

Comparative Example 2 n-Propyl alcohol

Comparative Example 3

Decyl alcohol/EO adduct; EOp=30.

Comparative Example 4

EO/PO random adduct of lauryl alcohol; EOp=30, POp=30.

Comparative Example 5

Blank (no bulking promoters).

Comparative Example 6

Commercial bulking promoter "Bayvolume P Liquid" (fatty acid polyamide polyamine type; manufactured by Bayer AG).

What is claimed is:

1. A process for producing a highly bulky pulp sheet which comprises the step of adding to a pulp paper 0.01 to 10% by weight, based on the weight of the pulp in any of the paper-making steps, of a compound represented by the following formula (1):

$$RO(EO)_m(PO)_nH \quad (1)$$

wherein R represent a linear or branched alkyl or alkenyl group having 6 to 22 carbon atoms or an alkylaryl group in which the alkyl group has 4 to 20 carbon atoms: E represents an ethylene group: P represents a propylene group; and m and n respectively indicate the average number of moles added in the ranges of $0 \leqq m \leqq 20$ and $0 \leqq n \leqq 50$ ; provided that $(EO)_m(PO)_n$ may have any of block and random arrangements and may begin with any of EO and PO, so as to thereby produce a highly bulky pulp sheet which has a bulk density that is at least 5% lower than a pulp sheet not containing the formula (1) compound and a tearing strength as measured according to JIS P 8116 of at least 90% of that of a pulp sheet not containing the formula (1) compound.

2. The process of claim 1, wherein R in the formula (1) compound is a linear or branched alkyl or alkenyl group having 8 to 18 carbon atoms.

3. The process of claim 1, wherein the compound (1) is obtained by causing a mixture of two or more ROH's to add at least one of either EO or PO.

4. The process of claim 1, which further comprises adding to the pulp at least one nonionic surfactant based on a polyhydric alcohol.

5. The process of claim 4, wherein the nonionic surfactant based on a polyhydric alcohol is at least one member selected from the group consisting of sugar alcohol/EO (ethylene oxide, the same applies hereinafter) adducts, fatty acid esters of the sugar alcohol/EO adducts, fatty acid esters of sugar alcohols, sugar/EO adducts, fatty acid esters of the sugar/EO adducts, sugar/fatty acid esters, and fat/EO adducts.

6. The process of claim 4, wherein the nonionic surfactant based on a polyhydric alcohol is at least one member selected from the group consisting of fatty acid esters of sugar alcohol/EO adducts and fat/EO adducts.

7. The process of claim 4, wherein the proportion of the compound (1) to the nonionic surfactant based on a polyhydric alcohol is from 5/5 to 10/0 (by weight).

8. The process of claim 4, wherein the proportion of the compound (1) to the nonionic surfactant based on a polyhydric alcohol is from 5/5 to 99/1 (by weight).

9. The process of claim 4, wherein $0 \leqq m \leqq 2$ and the proportion of the compound (1) to the nonionic surfactant based on a polyhydric alcohol is from 5/5 to 99/1 (by weight).

10. The process of claim 4, wherein m and n are zero and the proportion of the compound (1) to the nonionic surfactant based on a polyhydric alcohol is from 5/5 to 99/1 (by weight).

11. The process as set forth in claim 1, which comprises mixing the compound of formula (1) with water and a pulp feedstock to obtain a homogeneous slurry and subjecting the slurry to sheet forming.

12. The process as set forth in claim 1, which comprises mixing an aqueous emulsion or mixture containing 10 to 100 wt. % of the compound of formula 1 with a pulp feedstock to obtain a homogeneous slurry and subjecting the slurry to sheet forming.

13. A highly bulky pulp sheet obtained by the process as set forth in claim 1.

14. A highly bulky pulp sheet which comprises a pulp paper and 0.01 to 10% by weight, based on the weight of the pulp, of a compound represented by the following formula (1):

$$RO(EO)_m(PO)_nH \quad (1)$$

wherein R represent a linear or branched alkyl or alkenyl group having 6 to 22 carbon atoms or an alkylaryl group in which the alkyl group has 4 to 20 carbon atoms; E represents an ethylene group; P represents a propylene group; and m and n respectively indicate the average number of moles added in the ranges of $0 \leqq m \leqq 20$ and $0 \leqq n \leqq 50$; provided that $(EO)_m(PO)_n$ may have any of block and random arrangements and may begin with any of EO and PO, and which pulp sheet has a bulk density that is at least 5% lower than a pulp sheet not containing the formula (1) compound and a tearing strength as measured according to JIS P 8116 of at least 90% of that of a pulp sheet not containing the formula (1) compound.

15. A process for producing a highly bulky pulp sheet which comprises the steps of adding to a pulp paper 0.01 to 5% by weight, based on the weight of the pulp in any of the paper making steps, of a compound represented by the following formula (1):

$$RO(EO)_m(PO)_nH \quad (1)$$

wherein R represent a linear or branched alkyl or alkenyl group having 6 to 22 carbon atoms or an alkylaryl group in which the alkyl group has 4 to 20 carbon atoms; E represents an ethylene group; P represents a propylene group; and m and n respectively indicate the average number of moles added in the ranges of $0 \leqq m \leqq 20$ and $0 \leqq n \leqq 50$; provided that $(EO)_m(PO)_n$ may have any of block and random arrangements and may begin with any of EO and PO, so as to thereby produce a highly bulky pulp sheet which has a bulk density that is at least 5% lower than a pulp sheet not containing the formula (1) compound and a tearing strength as measured according to JIS P 8116 of at least 90% of that of a pulp sheet not containing the formula (1) compound.

16. The process as set forth in claim 15, which comprises mixing the formula (1) compound with water and a pulp feedstock to obtain a homogeneous slurry and subjecting the slurry to sheet forming.

17. The process as set forth in claim 15, which comprises mixing an aqueous emulsion or mixture containing 10 to 100 wt. % of the formula (1) compound with a pulp feedstock to obtain a homogeneous slurry and subjecting the slurry to a sheet forming step.

18. A highly bulky pulp sheet obtained by the process as set forth in claim 15.

19. A highly bulky pulp sheet which comprises a pulp paper and 0.01 to 5% by weight, based on the weight of the pulp paper, of a compound represented by the following formula (1):

$$RO(EO)_m(PO)_nH \quad (1)$$

wherein R represent a linear or branched alkyl or alkenyl group having 6 to 22 carbon atoms or an alkylaryl group in which the alkyl group has 4 to 20 carbon atoms; E represents an ethylene group; P represents a propylene group; and m and n respectively indicate the average number of moles added in the ranges of $0 \leqq m \leqq 20$ and $0 \leqq n \leqq 5$; provided that $(EO)_m(PO)_n$ may have any of block and random arrangements and may begin with any of EO and PO, and which pulp sheet has a bulk density that is at least 5% lower than a pulp sheet not containing the the formula (1) compound and a tearing strength as measured according to JIS P 8116 of at least 90% of that of a pulp sheet not containing the formula (1) compound.

* * * * *